US005511697A

United States Patent [19]

Gruenbacher et al.

[11] Patent Number: 5,511,697

[45] Date of Patent: Apr. 30, 1996

[54] RECLOSABLE POUCH AND METHOD OF CONSTRUCTION

[75] Inventors: Dana P. Gruenbacher, Fairfield, Ohio; Dale E. Barker, Hamilton, Ohio

[73] Assignee: The Procter & Gamble Company, Cincinnati, Ohio

[21] Appl. No.: 359,265

[22] Filed: Dec. 19, 1994

[51] Int. Cl.[6] ..... B65D 37/00

[52] U.S. Cl. ..... 222/107

[58] Field of Search ..... 222/107, 92, 215; 493/189, 214

[56] References Cited

U.S. PATENT DOCUMENTS

| | | | |
|---|---|---|---|
| 2,947,653 | 8/1960 | Fohr | 154/83 |
| 4,335,815 | 6/1982 | Babiol et al. | 206/277 |
| 4,394,936 | 7/1983 | Shavit | 222/107 |
| 4,854,737 | 8/1989 | Steer et al. | 383/127 |

*Primary Examiner*—Gregory L. Huson
*Attorney, Agent, or Firm*—Ronald W. Kock

[57] ABSTRACT

A reclosable pouch package for dispensing a product has a fitment in a folded end of the pouch. A substantially rigid fitment has an inner end, an outer end, and an orifice therethrough extending from the inner end to the outer end. The fitment also has a planar flange at the inner end. The pouch is formed from a substantially rectangular piece of thermoplastic film. The piece of film has a hole therein. Around the hole a depression is formed in the film either by thermoforming or cold forming. The depression is sized such that when the flange of the fitment is bonded to the film at the hole, and the piece of film is folded away from the fitment and fin-sealed closed, the folded end of the resulting pouch has minimal concavity and the pouch has parallel side seals.

14 Claims, 3 Drawing Sheets

RECLOSABLE POUCH AND METHOD OF CONSTRUCTION

FIELD OF THE INVENTION

The present invention relates to deformable pouch packages having reclosable fitments and to pouches which are formed on form/fill/seal machines.

BACKGROUND OF THE INVENTION

Pouch packages are traditionally formed on standard form/fill/seal machines, such as model IM, made by Klockner-Bartelt of Sarasota, Fla. In such machines a continuous web or webs of material are fed to a sealing station where a typically rectangular pouch is progressively formed and closed on three sides. An open side is then filled with a measured quantity of flowable material. In a downstream station, the open side is sealed closed, followed by an operation to separate individual pouches from the continuous web or webs. Form/fill/seal machines may be intermittent motion or continuous motion machines. They provide high productivity for manufacturing inexpensive small packages.

Most packages formed on form/fill/seal machines contain fluids which are intended to be squeezed out of a torn off corner or a tear in the pouch. A common example is the ketchup package provided with an order of fries from the local burger stand. The pouch has only a single use before it is discarded.

More recently, pouch packages have been designed for reclosability so that this inexpensive, minimal material package construction may be applied to products requiring the dispensing of multiple doses of fluid from the same package. To achieve reclosability, fitments have either been formed in the pouch or bonded to the pouch for threaded or other frictional type closures, which can be removed and then reinstalled. For example, U.S. Pat. No. 4,394,936 to Shavit, dated Jul. 26, 1983, shows a cardboard tube package and a method for forming, filling, and sealing it such that a threaded fitment is sealed into a folded end of the package.

A pouch made from rectangular stock or a web or webs having parallel edges is distorted by having a fitment installed at one end. That is, the fitment has a dimensional thickness at one end of the rectangular pouch, whereas the other end is sealed flat. The flat end tends to be wider than the fitment end. Shavit provides creases in his cardboard pouch at the end opposite the fitment in order to narrow the opposite end to the same width as the fitment end. Thus, his finished package retains a rectangular shape.

In a form/fill/seal machine such as shown by Shavit, it is necessary to maintain the side seals parallel between the opposing pouch ends so that a continuous web or webs may be directed in a straight line through the machine. If one end of a pouch were wider than the other, the line of pouches progressively formed, filled, and sealed would curve in the direction of the narrower end. Pouches made of easily deformable plastic film cannot be readily creased such as Shavit's cardboard pouch. Instead, either wrinkling occurs, which interferes with sealing, or side seals cannot be maintained parallel.

The drawings of Shavit illustrate another problem associated with pouches having fitments at one end. The fitment end of the pouch is shaped in a concave manner to facilitate the thickness of the fitment in the center while being flattened at the side seals. Shavit specifies a fitment flange which is flexible in order to assume the concave shape of the pouch. A disadvantage of the concave pouch end is that it recesses the fitment relative to the perimeter of the pouch. That is, the dispensing end of the fitment is guarded by the outermost comers of the pouch side seals. When product is dispensed from the fitment, the side seal comers often interfere with the targeting of the product. A longer and more expensive fitment may be needed as a result.

What is needed is a pouch with minimal concavity at the fitment end, and a solution to the form/fill/seal machining problem of maintaining parallel side seals in pouches with fitments.

SUMMARY OF THE INVENTION

In one aspect of the present invention a reclosable pouch package for dispensing a product comprises a substantially rigid fitment which has an inner end, an outer end, and an orifice therethrough extending from the inner end to the outer end. The fitment has a planar flange at its inner end. The package also comprises a piece of thermoplastic film which has a hole therein and a depression formed into the film around the hole by a forming means. The flange of the fitment is bonded to the piece of film at the hole. The piece of film is folded away from the fitment to generate a folded end and overlapping film edges. The overlapping film edges are thermobonded together to close the pouch except at the orifice in the fitment. The depression in the film is shaped to accommodate the planar flange of the rigid fitment. Such shape also provides the folded end of the pouch with minimal concavity. Such shape also provides the pouch with substantially parallel overlapping side edges adjacent the folded end. The forming means may either be thermoforming or cold forming.

The shape of the depression may be a flattened hemisphere formed around a concentric diamond shaped plane, which is coplanar with the piece of film. The diamond shaped plane has sufficient size to seat against the planar flange of the fitment. A long axis of the diamond shaped plane intersects the perimeter of the hemisphere, separating two halves of the depression.

In yet another aspect of the present invention, a method for constructing a reclosable pouch package comprises the steps of forming a depression in a piece of thermoplastic film by a forming means, and cutting a hole in the film to provide fluid communication between a substantially rigid fitment and the pouch. The rigid fitment has a planar flange and an orifice therethrough. Additional steps include bonding the flange of the fitment to the depression in the film, folding the film away from the fitment to generate a folded end and overlapping film edges, and bonding the overlapping film edges together to close the pouch except at the orifice in the fitment.

The method may further comprise a step of filling the pouch with product prior to bonding the overlapping film edges together. Alternatively, the method may further comprise a step of filling the pouch with product through the orifice of the rigid fitment after bonding the overlapping film edges together.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
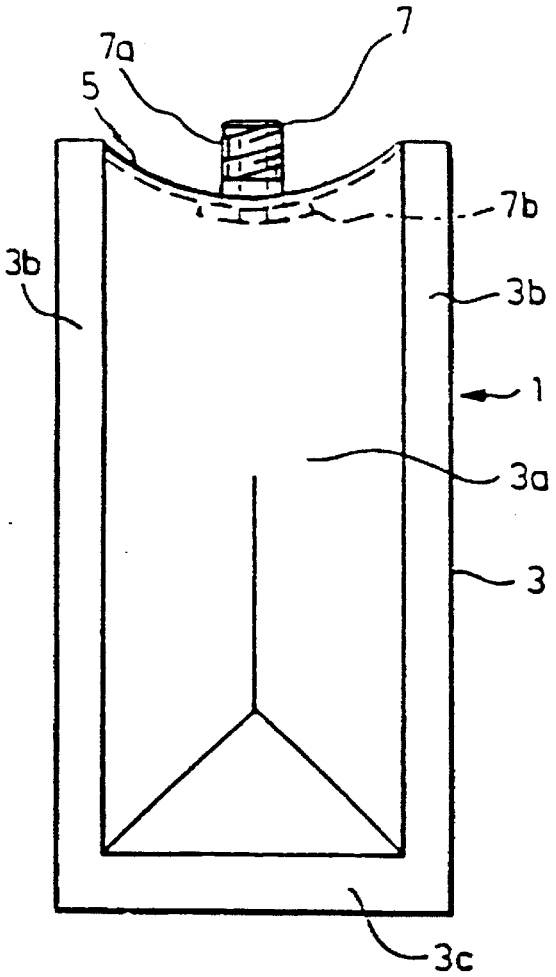
FIG. 1 PRIOR ART
FIG. 1 is a front elevation view of a prior art package, showing a concave folded end and a resilient fitment adapted to the curvature of the concave folded end.
Figure 2:
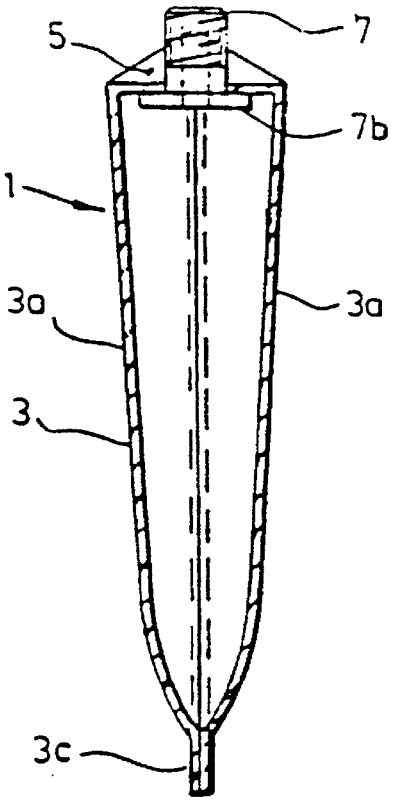
FIG. 2 PRIOR ART
FIG. 2 is a side elevation cross-section view thereof.
Figure 3:
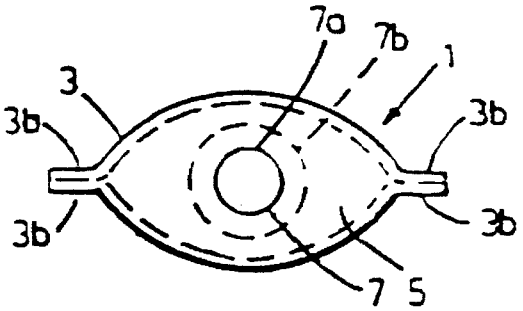
FIG. 3 PRIOR ART
FIG. 3 is a top plan view thereof.

Referring now to the drawings, and more particularly to FIGS. 1–3, there is shown a prior art reclosable pouch package which is generally indicated as 1. Pouch package 1 has cardboard body 3 with folded end 5 and resilient fitment 7 attached to folded end 5. Body 3 has sides 3*a*, edge seals 3*b*, and bottom seal 3*c*. Fitment 7 has threaded end 7*a* and flange 7*b*. When folded, end 5 has a concave shape because flange 7*b* has a width dimension which end 5 must accommodate, and folded end 5 has edges which are fin-sealed together. The concavity results from the gathering of material at the fin-seals. In order to maintain folded end 5 wrinkle-free for bonding to flange 7*b*, cardboard body 3 has predisposed fold lines formed in it. Similarly, fold lines are seen at the bottom end of pouch package 1. These fold lines enable the pouch to expand relatively uniformly along the length of pouch 1 so that side seals 3*b* will have substantially parallel edges. Such parallel edges are believed necessary for packages of this sort to be made in-line on a form/fill/seal machine.

Figure 4:
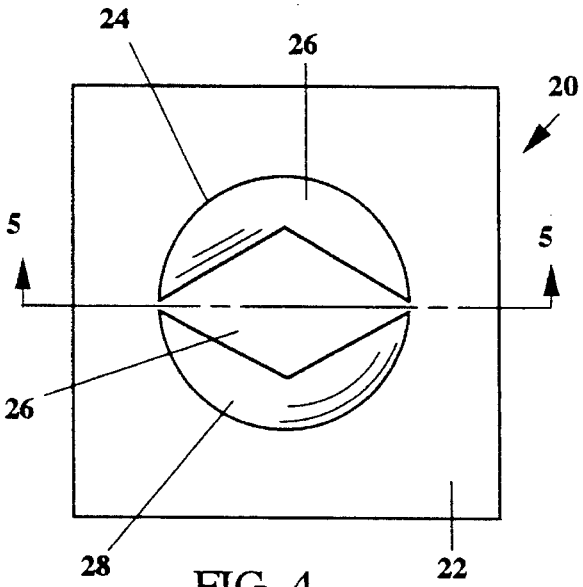
FIG. 4 is a top plan view of a thermoforming die, disclosing two raised halves which may be used to form a depression in a piece of film.
Figure 5:
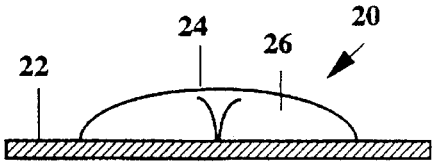
FIG. 5 is a sectioned side elevation view thereof, taken along section line 5—5 of FIG. 4, showing a flattened hemispherical shape of one raise half.

FIGS. 4 and 5 disclose a male thermoforming die of the present invention, generally indicated as 20. Die 20 has base surface 22 and raised portion 24. Raised portion 24 may be any shape which forms a piece of film as hereinafter described. However, it is preferably a flattened hemisphere with a concentric diamond shaped planar depression 26 at the level of base surface 22, the diamond shaped planar depression having a length which intersects the perimeter of the hemisphere to form two raised symmetrical halves 28 and 30, which look from the depressed side like a pair of open lips.

Figure 6:
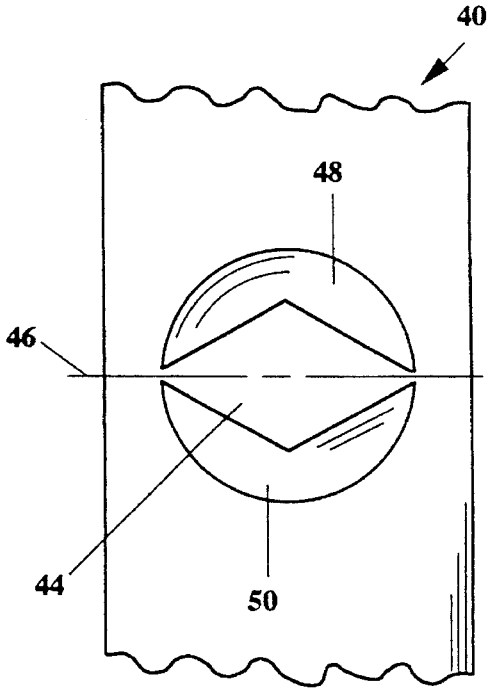
FIG. 6 is a top plan view of a piece of film of the present invention which has been thermoformed to have a depression matching the shape of the raised halves of the thermoforming die.

FIG. 6 shows a substantially rectangular piece of plastic film, generally indicated as 40. Piece of film 40 is thermoformed to have a shape which is the mirror image of raised portion 24 of the thermoforming die. The process of thermoforming is well known. It involves heating a film to near its softening temperature and then sucking it over a die by means of vacuum. The means for heating the film and sucking it over the forming die are not shown. It is also possible to cold form a shape into a piece of film 40, however, thermoforming is preferred because it is generally a quicker process which provides less film residual stress.

The desired depression may have any shape which accommodates a planar flange of a fitment, yet stretches film 40 such that when the pouch is folded and sealed, a folded end 42 (first shown in FIG. 10) has minimal concavity, also the desired depression provides substantially parallel, over lapping edges adjacent the folded end. However, a preferred shape is formed by the thermoforming die of FIGS. 4 and 5. That is, a flattened hemispherical recess is formed around a concentric diamond shaped plane 44, which is coplanar with piece of film 40. The diamond shaped plane has sufficient size to seat flat against a planar flange of a fitment. A length axis 46 of the diamond shaped plane intersects the perimeter of the hemisphere, separating two halves of the recess into depressions 48 and 50. The walls of depressions 48 and 50 are thinned to some extent by the forming process, but if the plastic film is thick enough, there are no cracks or holes in depressions 48 and 50.

Figure 7:
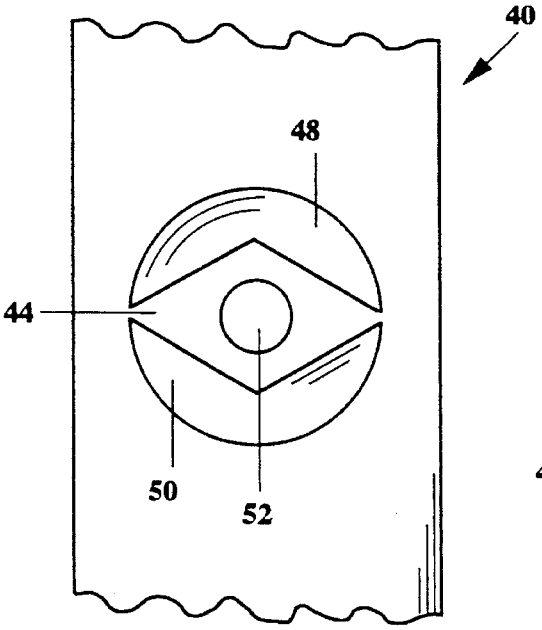
FIG. 7 is a top plan view thereof, showing a hole cut substantially in the center of the depression.

FIG. 7 shows piece of film 40 with depressions 48 and 50 having a circular hole 52 cut through diamond shaped plane 44 for a fitment to be installed. Hole 52 may be cut before or after forming depressions 48 and 50, but it is preferred that such cutting occur after forming. Cutting may be done by a hole punch, for example. Alternatively, radial slits may be made from a common centerpoint to enable a cylindrical fitment to be inserted through the hole. The latter approach provides no scrap pieces to deal with.

Figure 8:
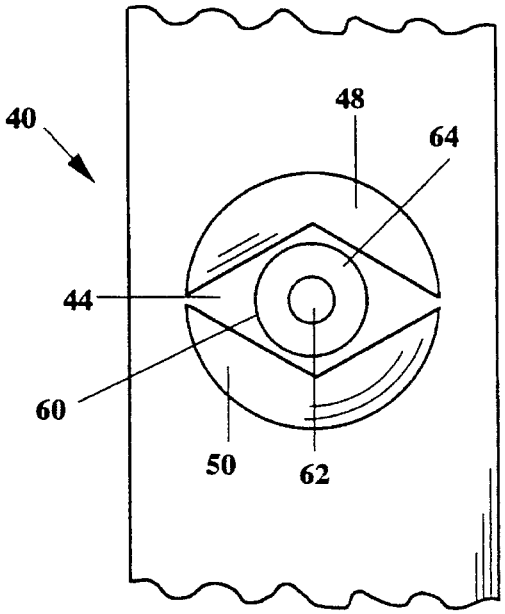
FIG. 8 is a top plan view thereof, showing a planar flange of a threaded fitment placed against the hole, the threaded portion of the fitment having been inserted through the hole.

FIG. 8 shows piece of film 40 having a fitment 60 inserted through hole 52. Fitment 60 has an orifice 62 centered therein and a flange 64 concentrically attached to an inner end of fitment 60. The outer end of fitment 60 has a threaded end 66 (first shown in FIG. 10) to match the threads of a fitment closure, not shown.

Figure 9:
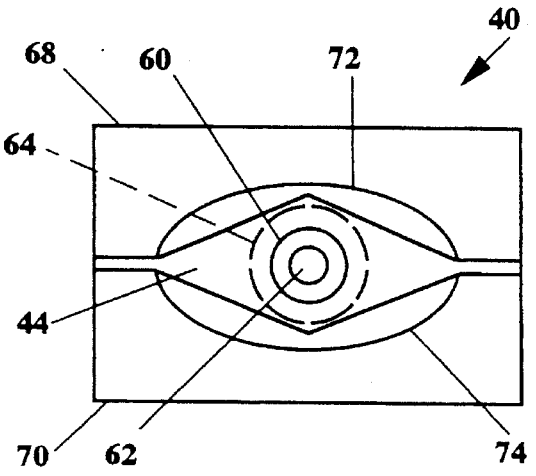
FIG. 9 is a top plan view of the film and fitment of the present invention disclosing the film folded away from the fitment such that the flange remains inside the folded film.

FIG. 9 shows the outside of piece of film 40 when it is folded about length axis 46 of diamond shaped plane 44, with fitment flange 64 bonded to the inside of piece of film 40. That is, film 40 is folded in half away from fitment 60 to generate overlapping film edges 68 and 70. Also seen in FIG. 9 are orifice 62, diamond shaped plane 44, and bulges 72 and 74, which are the outsides of depressions 48 and 50, respectively.

Figure 10:
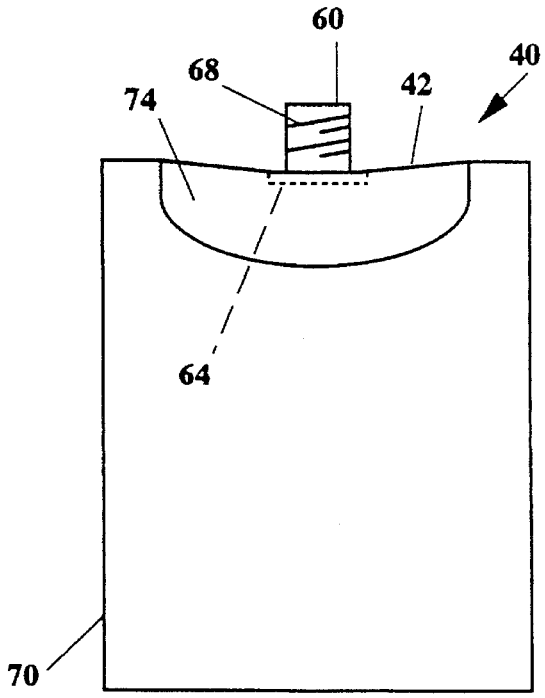
FIG. 10 is a front elevation view thereof, showing minimal concavity of the fold line compared to the prior art, and the depression forming a bulge near the fold line.

FIG. 10 shows a front view of the folded piece of film. In this view folded end 42 is seen, showing minimal concavity due to the film stretching at depressions 48 and 50, seen from the outside as bulges 72 and 74. Substantially rigid fitment 60 with threads 66 extends above folded end 42. Planar flange 64 of fitment 60 is shown bonded to the inside of the folded piece of film. However, flange 64 could also be bonded to the outside of the piece of film. Greater structural integrity is believed available by bonding the flange to the inside, however.

Figure 11:
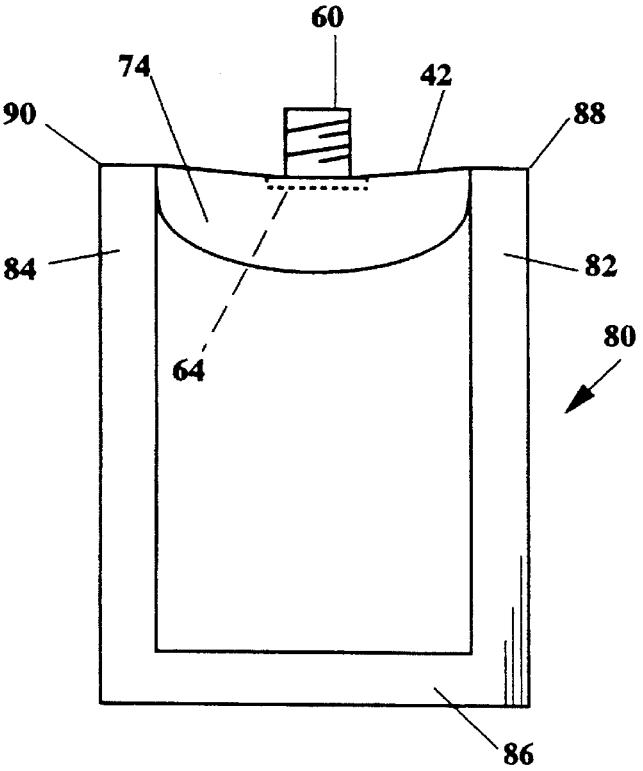
FIG. 11 is a front elevation thereof, showing overlapping edges of the folded piece of film bonded together at three sides to close the pouch, the two edges adjacent the fold line being substantially parallel.
Figure 12:
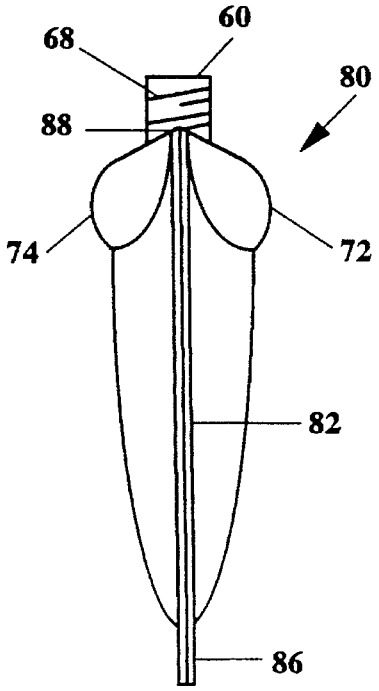
FIG. 12 is side elevation thereof, showing the bulge near the fold line and the pouch expanded when filled.

FIGS. 11 and 12 show a pouch package generally indicated as 80, which results from fin-sealing the overlapping edges 68 and 70 of folded piece of film 40 to form substantially parallel edges 82 and 84, and bottom edge 86. The bond at the fin-seal may be a thermobond and/or an adhesive bond. Upon bonding, outermost corners 88 and 90 are formed at substantially parallel edges 82 and 84, respectively. A comparison with FIG. 1 shows that outermost corners 88 and 90 do not pose nearly the degree of interference when targeting fluid from fitment 60 as do the comers of the prior art package. Folded end 42 of pouch package 80 is nearly flat compared to concave folded end 5 of the prior art package. Also, no creases are needed in the bottom portion of package 80 to compensate for the wider folded end where the fitment flange resides, as is the case in the prior art. FIG. 12 shows reclosable pouch package 80 filled with product.

In a particularly preferred embodiment of the present invention, the plastic film is a laminate structure including 48 gauge PET adhesive laminated to a 0.6 mil layer of EVOH adhesive laminated to a 3.0 mil layer of LDPE, made by Paramount Packaging of Chalfont, Pa. A substantially rectangular, fiat piece of film has dimensions of 51 mm by 204 mm, and is 0.11 mm thick. A hole is punched in the center of the film 13.3 mm diameter to enable the threaded part of a fitment to be slipped through the hole. A depression centered around the hole is preferably thermoformed in the fiat piece of film. The depression is shaped like two kidney beans or a pair of open lips, symmetrically formed around a fiat diamond which has not been formed. The outer perimeter of the depression is a circle. Its outer diameter is 44 mm and its maximum depth is 6.7 mm. The maximum depth of the depression is at least half the diameter of the fitment flange to provide room for folding the film in half with the fitment in place. The depth of thermoforming can be adjusted to change the concavity of the folded end of the pouch.

The thermoforming step is accomplished by heat and vacuum, using a laboratory benchtop Atlas Vac. Machine model R-12 thermoformer. Thermoforming conditions are preferably 140°–220° C. film heating temperature followed by vacuum stretching the film over the male form of FIG. 4 for 5–10 seconds.

The fitment is made of LDPE blended with 20% EVA and the resin is made by Quantum Chemical of Cincinnati, Ohio. The fitment is threaded to receive a 13 mm, 12 threads per inch standard closure. The outer end of the fitment is 12.7 mm in diameter. The fitment has a 6.4 mm diameter orifice axially through it and a planar flange at its inner end. The flange is 0.5 mm thick and has a diameter of 16.5 mm. The fitment is preferably bonded to the LDPE layer of the film on the side of the flange facing the threaded end of the fitment, so that the flange remains inside the pouch when the film is folded. The bonding method is preferably by a heated die about the size of the flange applied against the film while the fitment is backed up by a teflon coated anvil surface. Sealing conditions are 160°–170° C., 20 psi pressure, for 2 seconds.

Side and bottom end fin-seals are preferably 3 to 5 mm wide. They are made by a model 24LAB heat sealer, made by Vertrod Corporation of Brooklyn, N.Y. Edge sealing conditions are 170° C., 20 psi pressure, for 1–3 seconds.

Filling the pouch is preferably done before the bottom is sealed, but after the fitment is installed with closure attached and the side seals completed. Conditions and equipment for making the bottom seal are the same as for the side seals.

The filled and closed pouch is approximately 51 mm wide, 119 mm long, including the fitment and closure, and is approximately 20 mm thick at the thickest point.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A reclosable pouch package for dispensing a product, said package comprising:

a) a substantially rigid fitment having an inner end, an outer end, and an orifice extending from said inner end to said outer end, said fitment having a flange at said inner end; and b) a piece of thermoplastic film having a hole therein and a depression in said film, said flange of said fitment being bonded to said piece of film at said hole, said piece of film being folded away from said fitment to generate a folded end and overlapping film edges, said overlapping film edges being bonded together to close said pouch except at said orifice in said fitment, said depression in said film being shaped to accommodate said flange of said substantially rigid fitment.

2. The reclosable pouch package of claim 1 wherein said depression in said piece of film comprises a shape that provides said folded end of said pouch with minimal concavity.

3. The reclosable pouch package of claim 1 wherein said depression in said piece of film comprises a shape that provides said pouch with substantially parallel overlapping film edges adjacent to said folded end.

4. The reclosable pouch package of claim 1 wherein said depression is formed in said piece of thermoplastic film by thermoforming.

5. The reclosable pouch package of claim 1 wherein said depression is formed in said piece of thermoplastic film by cold forming.

6. The reclosable pouch package of claim 1 wherein said depression has a shape of a flattened hemisphere having a perimeter formed around a concentric diamond shaped plane, said diamond shaped plane being coplanar with said piece of film and having sufficient size to seat against said planar flange of said fitment, said diamond shaped plane having a long axis intersecting said perimeter of said flattened hemisphere forming two separated halves of said depression.

7. A method of constructing a reclosable pouch package, said package having a substantially rigid fitment attached thereto, said fitment having a flange and an orifice therethrough, said pouch having a hold aligned with said orifice such that said orifice provides fluid communication with said pouch, said method comprising the steps of:

a) forming a depression in a piece of film by a forming means;

b) bonding said flange of said fitment to said piece of film;

c) folding said piece of film away from said fitment to generate a folded end and overlapping film edges; and d) bonding said overlapping film edges together to close said pouch, said depression in said piece of film being shaped to accommodate said flange of said substantially rigid fitment when said piece of film is folded.

8. The method of claim 7 wherein said depression in said piece of film comprises a shape that provides said folded end of said pouch with minimal concavity.

9. The method of claim 7 wherein said depression in said piece of film comprises a shape that provides said pouch with substantially parallel overlapping film edges adjacent to said folded end.

10. The method of claim 7 wherein said depression has a shape of a flattened hemisphere having a perimeter formed around a concentric diamond shaped plane, said diamond shaped plane being coplanar with said piece of film and having sufficient size to seat against said planar flange of said fitment, said diamond shaped plane having a long axis intersecting said perimeter of said flattened hemisphere forming two separated halves of said depression.

11. The method of claim 7 wherein said forming means comprises thermoforming.

12. The method of claim 7 wherein said forming means comprises cold forming.

13. The method of claim 7 further comprising a step of filling said pouch with product prior to bonding said overlapping film edges together.

14. The method of claim 7 further comprising a step of filling said pouch with product through said orifice of said rigid fitment after bonding said overlapping film edges together.

* * * * *